US009842485B2

(12) United States Patent
Scaria et al.

(10) Patent No.: US 9,842,485 B2
(45) Date of Patent: Dec. 12, 2017

(54) PROGNOSTICATING PANIC SITUATIONS AND PRE-SET PANIC NOTIFICATION IN A SECURITY SYSTEM

(71) Applicant: Honeywell International Inc., Morristown, NJ (US)

(72) Inventors: Nikhil Scaria, Kannur (IN); Galib Gaurav, Saharsa (IN); Chaithra Mandanna.K, Bangalore (IN); Sunil Parisi, Bangalore (IN); Divyashree Krishnamurthy, Bangalore (IN)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 0 days.

(21) Appl. No.: 14/834,558

(22) Filed: Aug. 25, 2015

(65) Prior Publication Data

US 2017/0061776 A1 Mar. 2, 2017

(51) Int. Cl.

| | |
|---|---|
| ***G08B 23/00*** | (2006.01) |
| ***G08B 25/00*** | (2006.01) |
| ***G08B 21/02*** | (2006.01) |
| ***G08B 25/01*** | (2006.01) |

(52) U.S. Cl.

CPC ..... *G08B 25/001* (2013.01); *G08B 21/025* (2013.01); *G08B 21/0297* (2013.01); *G08B 25/008* (2013.01); *G08B 25/016* (2013.01)

(58) Field of Classification Search

CPC ..... G08B 25/001; G08B 29/16; G08B 25/008
USPC ..... 340/527, 506, 523, 528, 529
See application file for complete search history.

(56) References Cited

U.S. PATENT DOCUMENTS

| | | | | |
|---|---|---|---|---|
| 4,884,060 | A | 11/1989 | Shapiro | |
| 6,078,254 | A * | 6/2000 | Parker | G08B 25/008 307/10.4 |
| 8,493,202 | B1 * | 7/2013 | Trundle | G08B 29/02 340/502 |
| 9,424,737 | B2 * | 8/2016 | Bailey | G08B 25/001 |
| 2012/0133511 | A1 | 5/2012 | Blum et al. | |
| 2015/0221209 | A1 | 8/2015 | Janardhanan et al. | |

FOREIGN PATENT DOCUMENTS

WO WO 95/35558 A1 12/1995

OTHER PUBLICATIONS extended European search report for corresponding EP patent application 16185174.6, dated Jan. 17, 2017.

* cited by examiner

*Primary Examiner* — Toan N Pham
(74) *Attorney, Agent, or Firm* — Husch Blackwell LLP

(57) ABSTRACT

A system is provided that includes a security system that protects a secured geographic area, a delayed alarm process executing on a processor of the security system, wherein the delayed alarm process is activated by an authorized person through a user input of the security system, a timer of the delayed alarm process that delays sending an alarm message to a predetermined destination for a predetermined time period first following activation of the delayed alarm process by the authorized person through the user input, and a cancel feature of the delayed alarm process that disables the delayed alarm process upon receipt of an instruction from the authorized person, wherein, upon expiration of the predetermined time period without receipt of a reset, the delayed alarm process sends the alarm message to the predetermined destination.

20 Claims, 2 Drawing Sheets

PROGNOSTICATING PANIC SITUATIONS AND PRE-SET PANIC NOTIFICATION IN A SECURITY SYSTEM

FIELD

This application relates to security systems and, more particularly, to methods of protecting users of security systems.

BACKGROUND

Systems are known to protect people and assets within secured areas. Such systems are typically based upon the use of one or more wireless sensors that detect threats within the secured area.

Threats to people and assets may originate from any of a number of different sources. For example, a fire may kill or injure occupants who have become trapped by a fire in a home. Similarly, carbon monoxide from a fire may kill people in their sleep.

Alternatively, an unauthorized intruder, such as a burglar, may present a threat to assets within an area. Intruders have also been known to injure or kill people living within the area.

In the case of intruders, sensors may be placed in different areas based upon the respective uses of those areas. For example, if people are present during some portions of a normal day and not at other times, then sensors may be placed along a periphery of a space to provide protection while the space is occupied while additional sensors may be placed within an interior of the space and used when the space is not occupied.

In most cases, threat sensors are connected to a local control panel. In the event of a threat detected via one of the sensors, the control panel may sound a local audible alarm. The control panel may also send a signal to a central monitoring station.

While conventional security systems work well, it is sometimes difficult to protect occupants when outside parties must be given entry into a secured area. Accordingly, a need exists for better methods and an apparatus for protecting people within secured areas.

DETAILED DESCRIPTION

Figure 1:
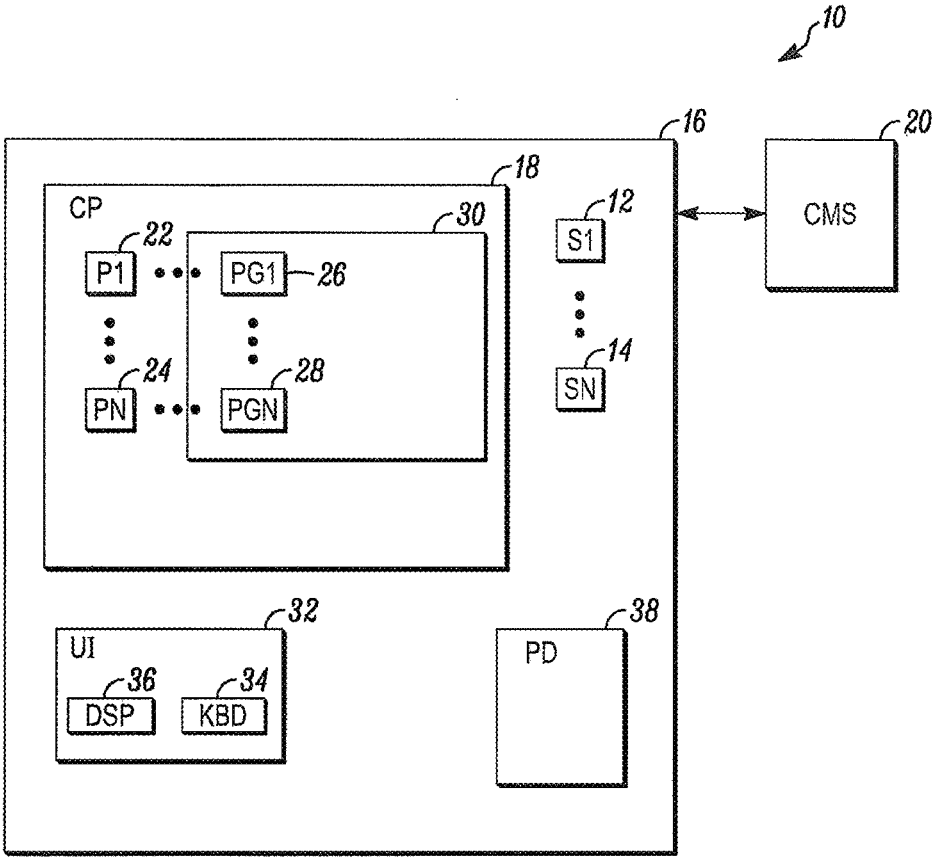
FIG. 1 illustrates a block diagram of a security system in accordance herewith.

While disclosed embodiments can take many different forms, specific embodiments thereof are shown in the drawings and will be described herein in detail with the understanding that the present disclosure is to be considered as an exemplification of the principles thereof as well as the best mode of practicing the same and is not intended to limit the application or claims to the specific embodiment illustrated.

FIG. 1 depicts a security system 10 shown generally in accordance with an illustrated embodiment. Included within the system are a number of threat sensors 12, 14 that detect threats within a secured geographic area 16. The threat sensors may be embodied under any of a number of different formats. For example, at least some of the sensors may be switches placed on the doors and/or windows surrounding the secured area in order to detect intruders. Other sensors may be embodied as passive infrared (PIR) sensors or video cameras with motion detection capability placed within an interior of the secured area in order to detect intruders who have been able to circumvent the sensors placed along the periphery.

Still other of the sensors may detect environmental threats. For example, some of the other sensors may be fire or toxic gas detectors.

The threat sensors may be monitored by a control panel 18. The control panel may be located within the secured area as shown in FIG. 1 or located remotely. Upon detection of activation of one of the threat sensors, the control panel sends an alarm message to a central monitoring station 20. The central monitoring station may respond by summoning the appropriate help (e.g., fire department, police, etc.).

The system may be controlled via a user interface 32. For example, an authorized user may arm or disarm the system by entering a personal identifier (PIN) through a keyboard 34 followed by activation of a function key. Status information (e.g., armed, disarmed, etc.) may be shown on a display 36.

Under one illustrated embodiment, the system may also include a wireless portable device (e.g., a smartphone, iPad, etc.) 38 carried by an authorized user. The portable device also includes a keyboard and a display showing system status information.

Included within the control panel, the user interface, and the portable device may be circuitry that accomplishes the functionality described below. For example, the control panel, user interface, and portable device may each include one or more processor apparatuses (processors) 22, 24 each operating under control of one or more computer programs 26, 28 loaded from a non-transitory computer readable medium (memory) 30. As used herein, reference to a step performed by a computer program is also reference to the processor executing that step of the program.

In this regard, an alarm processor may monitor a status of each of the sensors. Upon detecting activation of one of the sensors, the processor may compose an alarm message to be sent to the central monitoring station. The alarm message may include an identifier of the system (e.g., an address, account number, etc.), an identifier of the sensor, an indicator of the type of sensor (e.g., fire, gas, intruder, etc.), and a time.

Similarly, a status processor may establish a system status by monitoring the user interface. Upon detecting entry of a predetermined PIN and arm key, the system enters an armed status. Similarly, upon detecting entry of a predetermined PIN and disarm key, the system enters a disarmed status.

From time to time, authorized users of the secured area may need to allow entry by unknown persons into the secured area. This may occur during delivery of furniture or other heavy appliances. Alternatively, a plugged drain may require admittance of a plumber. While such admittances normally do not represent a risk to the user, there have also been incidents where criminals have used the promise of delivery or service to gain entrance to a home for criminal activities. However, once inside a home, the criminal may seize upon the opportunity to attack or kill a homeowner or steal the homeowner's possessions.

In order to address this problem, the security system uses a special delayed alarm process (system) in order to allow entry by an unknown third party into the secured area while still providing at least some protection to an authorized user. The delayed alarm process may be initiated from either the armed or disarmed state by activating a predefined control key or pushbutton on the user interface. In the case of a home, the homeowner may activate the key before unlocking and opening the door for an unknown third party.

In effect, activating the delayed alarm pushbutton sets an alarm that will be reported to a predefined communication system destination after a predetermined time delay unless canceled or reset. The predetermined time delay may involve some appropriate delay (e.g., 5 minutes) that allows the homeowner enough time to open the door and determine the purpose of the visit by the third party. If the homeowner is comfortable that the visit is legitimate, then the homeowner may cancel the alarm. The homeowner may do this by activating a cancel button on the user interface, thereby terminating the delayed alarm process.

If the homeowner is still unsure as to his/her safety, then the homeowner may activate a reset button. Activating the reset button does not cancel the alarm, but merely resets a timer inside the delayed alarm process that, in effect, doubles the time period during which the homeowner has to determine the legitimacy of the visit.

If the timer operating from within the delayed alarm process expires, then an alarm message is sent to the predetermined destination. The predetermined destination may be the central monitoring station and/or a geographic neighbor of the authorized user. The neighbor (being close by) may receive the alarm and decide to investigate, thereby ensuring the safety of the authorized user. In contrast, the central monitoring station may place a call to the authorized user to inquire as to the user's safety or simply summon the police.

In general, the delayed alarm process may be one or more software programs executing on a corresponding processor(s) of the security system. The activation, reset, and cancel control buttons are pushbuttons or software keys displayed on the control panel of the security system.

Under one illustrated embodiment, the activation, reset, and cancel pushbuttons of the delayed alarm process are also displayed on a portable device carried by the user. In this situation, a communication processor of the portable device forms a communication connection with the delayed alarm processor of the security system to transfer at least some of the control functionality of the delayed alarm process to the portable device. In this regard, a monitoring processor displays a warning to the authorized user when the predetermined time period is about to expire. For example, if the time delay is 5 minutes, then after 4 minutes and 40 seconds, the monitoring processor presents a warning on the portable device warning the authorized user that, in another 20 seconds, a silent alarm will be sent to the predetermined destination.

In addition to displaying the warning, the monitoring processor may also display cancel and reset keys (pushbuttons) on the display of the portable device. Upon receiving the warning, the user may activate the cancel button to cancel the delayed alarm process(or) or activate the reset button to delay sending of the silent alarm for another 5 minutes.

In general, the delayed alarm process is a significant improvement over conventional security systems. For example, there are times when a person (e.g., a homeowner) may need outside services, such as a plumber or home delivery of household goods. There have been reported cases where a plumber or delivery service person has attacked and looted the residence of a homeowner. For example, even a criminal can be mistaken or disguised as a plumber or delivery person and come to the person's home in a manner that does not raise suspicions. Since the homeowner is expecting some person to visit him/her, the criminal or disguised person can easily enter the home without suspicion. Once inside, the intruder may attack the homeowner after entering his/her home. In such cases, the homeowner is often not in a situation to raise or otherwise activate a panic alarm. The trend of such crimes is very high in South Asian countries, such as India.

Figure 2:
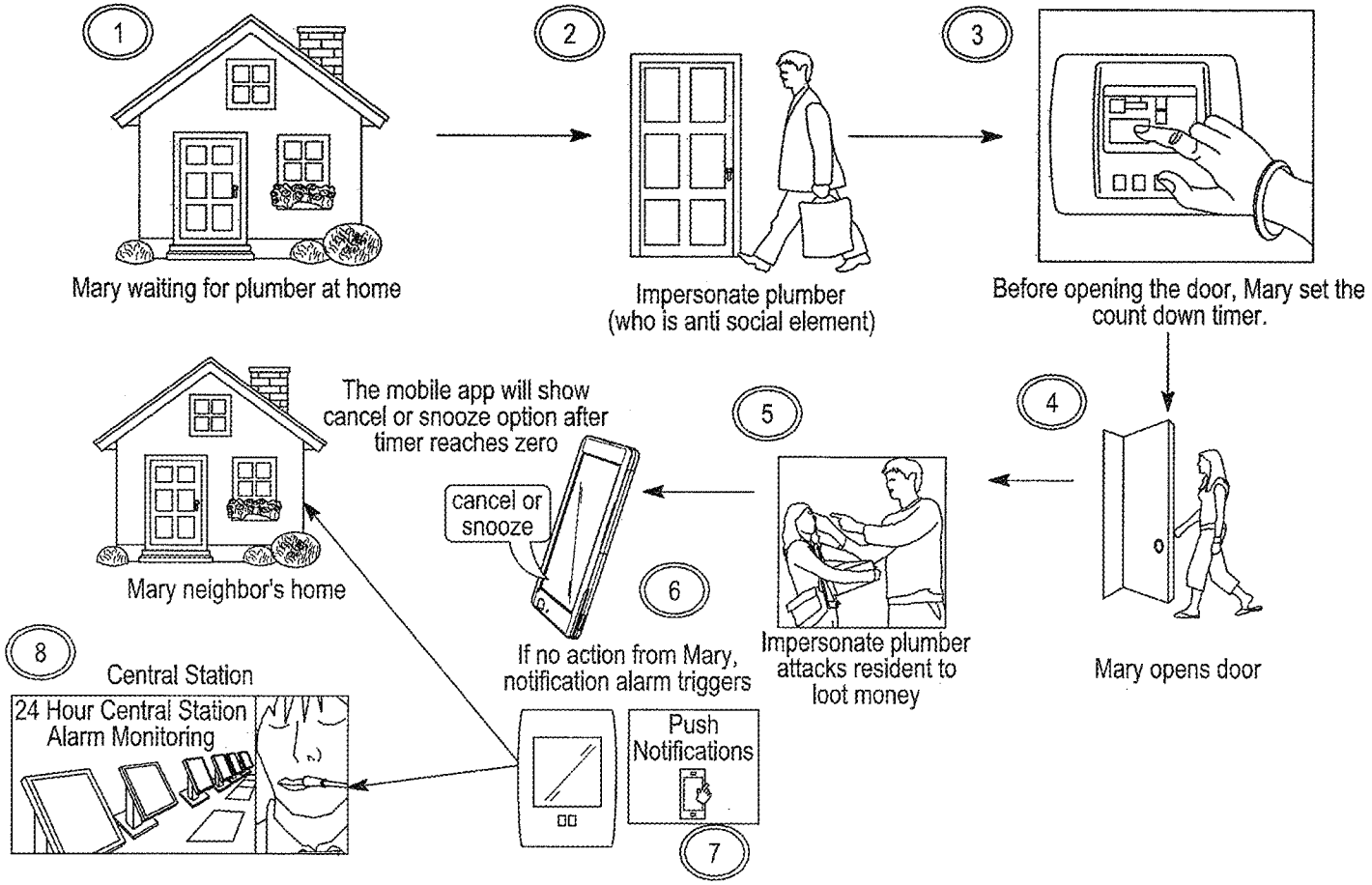
FIG. 2 illustrates a sequence of steps of use of the system of FIG. 1.

The delayed alarm system addresses the above described problem in a simple and robust manner. The use of the system may be exemplified by offering a simple series of steps for its use as shown in FIG. 2. For example, assume that Mary is alone at home each day after her husband, John, leaves for the office. One day, John has a problem with his kitchen plumbing so he calls a plumbing service for assistance. Tom, the plumber (who has a criminal background), knocks on John's door when John is not there. (People with criminal backgrounds are hired by such services in many countries without much background investigation.)

Mary, who is alone at home, opens the door and allows Tom to come inside since she is expecting a plumber. By making use of this opportunity, Tom can attack Mary and loot the home. (Here is where the delay alarm system can be of use.) Before opening the door for Tom, Mary sets a countdown timer of the delayed alarm system for a specified interval of time into the security panel installed in her home. The system should allow the user to choose this period as required. It can ideally be 5 minutes, but any period can be chosen. The countdown timer starts ticking the moment Tom enters the home. In this case, there is also an application installed in Mary's cellphone, which is connected to the security panel (via WiFi or GPRS). The timer will send a prompt to Mary's phone once the timer reaches zero asking her to confirm that she is safe. There are two options in the application. The first option is to snooze (reset) the timer. (This will again start the countdown for the same period of time and repeat the same steps.) Mary will use this option if Tom is still working in her kitchen. The second option is to cancel the timer. (This will cancel the timer or reset the application.) Mary will use this option if Tom has left the home after finishing the job. To use both of these options, Mary has to enter the panel's user code.

If Mary doesn't press any of the buttons of the application, then it will be assumed that she is in trouble. The application will send an alert message to John as well as to a neighbor immediately (using a short message service (SMS)/recorded audio call, etc.). Upon receiving the notification, John/neighbor can come to Mary's aid. It should be noted that there is also an option of sending an alarm to the central monitoring station upon failing to receive a confirmation from Mary. If Mary doesn't cancel or snooze the timer within 30 seconds, then there can be a continuous beeping sound generated by the panel. Even after another 30 seconds of beeping, if Mary doesn't cancel the alarm, then a notification can be sent to the central monitoring service. Mary will be able to cancel the alarm from her mobile application at any time.

Anticipating panic situations and the ability to pre-set alarms/notifications in the panel are new features shown in FIGS. 1 and 2 and are not available in prior systems. The solution of FIGS. 1 and 2 is very much suited for many markets where the situations cited above are frequently reported. Notifying neighbors is more effective in some countries where first responder's (police, ambulance) response time is relatively high.

In general, the system includes a security system that protects a secured geographic area, a delayed alarm process executing on a processor of the security system, wherein the delayed alarm process is activated by an authorized person through a user input of the security system, a timer of the delayed alarm process that delays sending an alarm message to a predetermined destination for a predetermined time period first following activation of the delayed alarm process by the authorized person through the user input, and a cancel feature of the delayed alarm process that disables the predetermined time period upon receiving instructions from the authorized person, wherein, upon expiration of the predetermined time period without receipt of a reset, the delayed alarm process sends the alarm message to the predetermined destination.

Alternatively, the system includes a security system that protects a secured geographic area of a home or business, an alarm processor that protects an authorized human user of the security system within the secured geographic area, wherein the alarm processor is activated by the authorized human user through a user interface of the security system, a timer of the alarm processor that waits a predetermined time period following activation by the authorized human user through the user interface before issuing an alarm, wherein the alarm is issued by sending an alarm message to a predetermined destination, and a cancel feature of the alarm processor that disables the alarm processor upon receiving an acknowledgement from the authorized human user before expiration of the predetermined time period.

Alternatively, the system includes a security system having one or more threat sensors that protects a secured geographic area of a home or business, an alarm processor of the security system that protects an authorized human user of the security system within the secured geographic area, wherein the alarm processor is activated by the authorized human user through a user interface of the security system, a timer of the alarm processor that waits a predetermined time period following activation through the user interface before issuing an alarm by sending an alarm message to a predetermined destination, a cancel feature of the alarm processor that cancels the alarm by disabling the alarm processor or resets the predetermined time period upon receiving instructions from the authorized human user before expiration of the predetermined time period, and a wireless portable device carried by the authorized human user that provides instructions to cancel the alarm or reset the timer.

From the foregoing, it will be observed that numerous variations and modifications may be effected without departing from the spirit and scope hereof. It is to be understood that no limitation with respect to the specific apparatus illustrated herein is intended or should be inferred. It is, of course, intended to cover by the appended claims all such modifications as fall within the scope of the claims. Further, logic flows depicted in the figures do not require the particular order shown or sequential order to achieve desirable results. Other steps may be provided, steps may be eliminated from the described flows, and other components may be added to or removed from the described embodiments.

The invention claimed is:

1. An apparatus comprising:

a security system that protects a secured geographic area;

a delayed alarm process executing on a processor of the security system, wherein the delayed alarm process is activated through a user input of the security system;

a timer of the delayed alarm process that delays sending an alarm message to a predetermined destination for a predetermined time period first following activation of the delayed alarm process through the user input of the security system;

a cancel feature of the delayed alarm process that disables the delayed alarm process upon receipt of a cancel instruction through the user input of the security system; and a reset feature of the delayed alarm process that resets the predetermined time period upon receipt of a reset instruction through the user input of the security system, wherein, upon expiration of the predetermined time period without receipt of the reset instruction or the cancel instruction, the delayed alarm process sends the alarm message to the predetermined destination.

2. The apparatus as in claim 1 wherein the user input of the security system includes a portable wireless device.

3. The apparatus as in claim 1 further comprising a reminder feature of the delayed alarm process executing on the processor that sends a reminder that the predetermined time period is about to expire.

4. The apparatus as in claim 3 further comprising a portable wireless device that displays the reminder.

5. The apparatus as in claim 4 further comprising a wireless application executing on a processor of the portable wireless device that couples the delayed alarm process with a user interface of the portable wireless device.

6. The apparatus as in claim 5 further comprising a user input of the portable wireless device that displays a reset button of the delayed alarm process, wherein activation of the reset button of the portable wireless device resets the predetermined time period of the delayed alarm process through the wireless application.

7. The apparatus as in claim 5 further comprising a user input of the portable wireless device that displays a cancel button of the delayed alarm process, wherein activation of the cancel button of the portable wireless device cancels the delayed alarm process through the wireless application.

8. The apparatus as in claim 1 wherein the predetermined destination includes a system address of a neighbor of an authorized user of the security system.

9. The apparatus as in claim 1 wherein the predetermined destination includes a system address of a central monitoring station.

10. An apparatus comprising:

a security system that protects a secured geographic area of a home or a business;

an alarm processor within the secured geographic area, wherein the alarm processor is activated through a user interface of the security system;

a timer of the alarm processor that waits a predetermined time period following activation of the alarm processor through the user interface of the security system before issuing an alarm, wherein the alarm is issued by sending an alarm message to a predetermined destination;

a reset feature of the alarm processor that resets the predetermined time period upon receiving a reset instruction before expiration of the predetermined time period; and a cancel feature of the alarm processor that disables the alarm processor upon receiving a cancel instruction before the expiration of the predetermined time period.

11. The apparatus as in claim 10 wherein the user interface of the security system includes a portable wireless device.

12. The apparatus as in claim 10 further comprising a reminder processor of the security system that sends a reminder that the predetermined time period is about to expire.

13. The apparatus as in claim 12 further comprising a portable wireless device that displays the reminder.

14. The apparatus as in claim 13 further comprising a wireless application executing op a processor of the portable wireless device that couples the alarm processor with a user interface of the portable wireless device.

15. The apparatus as in claim 14 wherein the user interface of the portable wireless device displays a reset button of the alarm processor, and wherein activation of the reset button resets the predetermined time period of the alarm processor through the wireless application.

16. The apparatus as in claim 14 wherein the user interface of the portable wireless device displays a cancel button of the alarm processor, and wherein activation of the cancel button cancels the alarm through the wireless application.

17. The apparatus as in claim 10 wherein the predetermined destination includes a system address of a neighbor of an authorized user of the security system.

18. The apparatus as in claim 10 wherein the predetermined destination includes a system address of a central monitoring station.

19. An apparatus comprising:

a security system having one or more threat sensors that protects a secured geographic area of a home or a business;

an alarm processor of the security system within the secured geographic area, wherein the alarm processor is activated through a user interface of the security system;

a timer of the alarm processor that waits a predetermined time period following activation of the alarm processor through the user interface before issuing an alarm by sending an alarm message to a predetermined destination;

a cancel feature of the alarm processor that cancels the alai n upon receiving a cancel instruction before expiration of the predetermined time period;

a reset feature of the alarm processor that resets the predetermined time period upon receiving a reset instruction before the expiration of the predetermined time period; and a wireless portable device that provides the reset instruction and the cancel instruction.

20. The apparatus as in claim 19 wherein the predetermined destination includes one of a neighbor of an authorized user of the security system or a central monitoring station.

* * * * *